US006159308A

United States Patent [19]

Uchida et al.

[11] Patent Number: 6,159,308

[45] Date of Patent: Dec. 12, 2000

[54] RARE EARTH PERMANENT MAGNET AND PRODUCTION METHOD THEREOF

[75] Inventors: Kimio Uchida; Masahiro Takahashi, both of Saitama-ken, Japan

[73] Assignee: Hitachi Metals, Ltd., Tokyo, Japan

[21] Appl. No.: 09/209,426

[22] Filed: Dec. 11, 1998

[30] Foreign Application Priority Data

Dec. 12, 1997 [JP] Japan ..... 9-342395

[51] Int. Cl.[7] ..... H01F 1/00

[52] U.S. Cl. ..... 148/302; 148/103; 419/30; 419/32; 419/40; 252/62.5

[58] Field of Search ..... 148/101, 302; 252/62.5; 419/30, 32, 40

[56] References Cited

U.S. PATENT DOCUMENTS

| | | | |
|---|---|---|---|
| 4,770,702 | 9/1988 | Ishigaki et al. | 75/244 |
| 4,837,109 | 6/1989 | Tokunaga et al. | 420/83 |
| 4,917,724 | 4/1990 | Sharma | 75/350 |
| 4,978,398 | 12/1990 | Iwasaki et al. | 148/101 |
| 5,162,064 | 11/1992 | Kim et al. | 148/302 |
| 5,183,494 | 2/1993 | Liu et al. | 75/349 |
| 5,281,250 | 1/1994 | Hamamura et al. | 75/255 |
| 5,489,343 | 2/1996 | Uchida et al. | 148/103 |

FOREIGN PATENT DOCUMENTS

| | | | |
|---|---|---|---|
| 59-219404 | 12/1984 | Japan | B22F 9/20 |

*Primary Examiner*—Ngoclan Mai
*Attorney, Agent, or Firm*—Sughrue, Mion, Zinn, Macpeak & Seas, PLLC

[57] ABSTRACT

A method of producing an R—Fe—B-based, sintered permanent magnet, wherein R is at least one rare earth element including Y, having a small oxygen content. A coarse alloy powder prepared by a reductive diffusion method is milled and recovered into a solvent to form a slurry. The slurry is wet-compacted to form a green body which is then sintered after removing the solvent. The milling, recovering, wet-compacting, solvent-removing and sintering steps are carried out while preventing the powder, slurry and green body from being brought into contact with air to minimize the oxygen content in the final sintered permanent magnet. The sintered permanent magnet produced has a high density and a high magnetic properties due to a low oxygen content.

9 Claims, No Drawings

RARE EARTH PERMANENT MAGNET AND PRODUCTION METHOD THEREOF

BACKGROUND OF THE INVENTION

The present invention relates to a high-performance, R—Fe—B-based, sintered permanent magnet, wherein R is one or more of rare earth elements including Y, made of a coarse alloy powder prepared by a reductive diffusion method. The present invention also relates to a method for producing the R—Fe—B-based, sintered permanent magnet.

An R—Fe—B-based, sintered permanent magnet may be typically produced by a metallurgical method including the steps of melting and casting metals for the magnet to form an alloy ingot, pulverizing the ingot to alloy powder, molding and sintering the alloy powder, heat-treating the sintered body and then working it. Since the rare earth metals are extremely expensive, efforts have been directed toward reducing the production cost of the permanent rare earth magnet.

Japanese Patent Laid-Open No. 59-219404 proposes a so-called reductive diffusion method for preparing a coarse alloy powder for producing a rare earth permanent magnet. In this method, cheep rare earth oxides in the starting material are reduced by a reducing agent such as metallic calcium, metallic magnesium, etc. to rare earth elements which diffuse into the other alloying metals in the starting material. Since the reduction of the rare earth oxides is accompanied by by-production of CaO, MgO, etc., the by-produced oxide should be removed from the coarse alloy powder, because they are detrimental to magnetic properties of the resultant magnet. Japanese Patent Laid-Open No. 59-219404 further teaches to convert the by-produced oxides to water-soluble hydroxides such as $Ca(OH)_2$, $Mg(OH)_2$, etc. by reacting them with water, and wash away the hydroxides. However, as known in the art, this reaction proceeds with vigorous heat generation. Therefore, the surface of the coarse alloy powder is likely to be oxidized during the washing process, thereby increasing the oxygen content of the final coarse alloy powder. When such a coarse alloy powder having a high oxygen content is made into a sintered magnet by pulverizing the coarse alloy powder into fine powder by a usual jet milling method, ball milling method or attritor milling method, dry-compacting the fine powder into a green body, and sintering the green body, the resultant sintered magnet has an oxygen content higher than that of a sintered magnet made of an alloy powder from an ingot prepared by a melting/casting method, thereby deteriorating magnetic properties, particularly reducing a coercive force.

With such a disadvantage, the use of the coarse alloy powder prepared by the reductive diffusion method has been limited. In some case, the coarse alloy powder prepared by the reductive diffusion method has been used in combination with the expensive alloy powder prepared by the melting/casting method. However, this cannot reduce largely the production cost of the rare earth permanent magnet. Thus, the advantage of the cheap coarse alloy powder prepared by the reductive diffusion method has not been sufficiently utilized in practice.

OBJECT AND SUMMARY OF THE INVENTION

Accordingly, an object of the present invention is to provide a sintered rare earth permanent magnet with improved magnetic properties made of an R—Fe—B-based coarse alloy powder prepared by the reductive diffusion method.

In view of the above object, the inventors have made intense research on reducing the oxygen content in a sintered rare earth permanent magnet made of a coarse alloy powder prepared by the reductive diffusion method having a higher oxygen content as compared with a coarse alloy powder prepared by pulverizing an ingot of the melting/casting method. As a result thereof, the present inventors have found that the oxygen content can be remarkably reduced by thoroughly preventing a fine alloy powder and a green body from being oxidized in a step of milling the coarse alloy powder into the fine powder and the subsequent steps, thereby obtaining a sintered rare earth permanent magnet having a low oxygen content and an improved coercive force as compared with known rare earth permanent magnets.

Thus, in a first aspect of the present invention, there is provided a method of producing an R—Fe—B-based, sintered permanent magnet wherein R is at least one rare earth element including Y, comprising steps of (1) milling an R—Fe—B-based coarse alloy powder prepared by a reductive diffusion method into a fine powder in an atmosphere containing oxygen in an amount of 0.01 volume % or less, the atmosphere being a nitrogen gas atmosphere, an argon gas atmosphere, or a mixed atmosphere of nitrogen gas and argon gas; (2) directly recovering the fine powder into a solvent to form a slurry without bringing the fine powder into contact with air, the solvent being a mineral oil, a synthetic oil, a vegetable oil or a mixture thereof; (3) wet-compacting the slurry to form a green body while applying a magnetic field; (4) removing the solvent from the green body; and (5) sintering the green body in a vacuum or in an argon gas atmosphere while preventing the green body from being brought into contact with air after the removing step and before the sintering step.

In a second aspect of the present invention, there is provided an R—Fe—B-based, sintered permanent magnet produce by the above method, which contains a small amount of oxygen as compared with known R—Fe—B-based, sintered permanent magnets, thereby having a high density and a coercive force.

DETAILED DESCRIPTION OF THE INVENTION

The R—Fe—B-based coarse alloy powder, wherein R is one or more of rare earth elements including Y, for producing an R—Fe—B-based, sintered permanent magnet of the present invention may be prepared as follows.

(1) First, a powdery mixture is prepared, which mixture contains predetermined amounts of at least one rare earth oxide such as $Nd_2O_3$, $Dy_2O_3$, $Pr_6O_{11}$, etc., metallic Ca and/or metallic Mg as a reducing agent, and other alloying materials including Fe powder, Co powder which may be Co oxide powder, B powder which may be Fe—B powder or $B_2O_3$ powder, Fe—Nb powder, Fe—Ga powder, Cu powder, etc. The powdery mixture is heated in a non-oxidative atmosphere to reduce the rare earth oxides, etc. to their element forms and cause the interdiffusion of the constituent elements, thereby forming an alloy structure. The product after the reductive diffusion treatment is immersed into an aqueous washing solution, for example, an aqueous solution dissolving suitable amounts of sucrose and various types of antioxidants, to remove the by-produced CaO, MgO, etc. by dissolving them into water. The washed product is then dried to obtain the R—Fe—B-based coarse alloy powder.

(2) Defective green bodies, sintered bodies and cast bodies having cracks, chipped edges, etc. recovered during the production of R—Fe—B-based permanent magnet are pulverized into a powder. The powder is added with metallic Ca and/or metallic Mg as the reducing agent in a suitable amount, and then subjected to the reductive diffusion treatment, the washing treatment and the drying treatment as mentioned above to obtain the R—Fe—B-based coarse alloy powder.

(3) Defective green bodies, sintered bodies and cast bodies having cracks, chipped edges, etc. recovered during the production of R—Fe—B-based permanent magnet are pulverized into a powder. To adjust the alloy composition, the powder is added with a rare earth oxide such as $Nd_2O_3$, $Dy_2O_3$, $Pr_6O_{11}$, etc., and other alloying materials, if desired, such as Fe powder, Co powder which may be Co oxide powder, B powder which may be Fe—B powder or $B_2O_3$ powder, Fe—Nb powder, Fe—Ga powder, Cu powder, etc. The powder mixture thus prepared is further added with metallic Ca and/or metallic Mg as a reducing agent, and then subjected to the reductive diffusion treatment, the washing treatment and the drying treatment as mentioned above to obtain the R—Fe—B-based coarse alloy powder.

In a known method, a fine milling of a coarse alloy powder by using a jet mill, etc. is usually carried out in nitrogen gas atmosphere or in argon gas atmosphere while regulating the oxygen content of the atmosphere within about 0.05–0.5 volume %, because the fine powder prepared without introducing oxygen into the atmosphere is likely to generate heat or catch fire in the subsequent steps. Therefore, the fine powder contains more oxygen as compared with the starting coarse alloy powder because the powder takes up oxygen from the atmosphere during the milling step.

In another known method, a coarse alloy powder is milled in an organic solvent such as hexane, toluene, etc. in a ball mil, etc., and then the fine powder thus produced is dried for use in the subsequent steps. However, since the fine powder is oxidized during the drying step, the compacting step for making the fine powder into a green body and the subsequent steps, the oxygen content increases. Thus, the oxygen content of the fine powder is larger than that of the original oxygen content of the coarse alloy powder. In addition, since the coarse alloy powder is milled to have a particle size of several micrometers, the powder takes up the organic solvent to increase the carbon content of the fine powder to about 0.2% by weight or so. This causes a remarkable deterioration of magnetic properties of the resultant magnet, in particular, a remarkable reduction in the coercive force iHc.

Therefore, when the coarse alloy powder prepared by the reductive diffusion method, which has an oxygen content higher than that of the coarse alloy powder obtained by pulverizing an ingot produced by the melting/casting method, is used in the above known milling methods, the resultant sintered magnet contains a further increased amount of oxygen to result in deterioration of magnetic properties, particularly reduction in the coercive force iHc.

To avoid the disadvantage in the known methods, in the present invention, the R—Fe—B-based coarse alloy powder prepared by the reductive diffusion method is milled to a fine powder by a jet mill, etc. in an atmosphere substantially free from oxygen, for example, in nitrogen gas, argon gas and a mixed gas thereof each having an oxygen concentration of 0.01 volume % or less, preferably 0.005 volume % or less, and more preferably 0.002 volume % or less. As a result thereof, the increase in the oxygen amount due to the oxidation during the milling step can be minimized. If the oxygen concentration of the milling atmosphere is larger than 0.01 volume %, the oxygen content of the fine powder increases due to the oxidation during the milling step, and therefore, the oxygen content in the final sintered magnet becomes large to fail in achieving a high coercive force iHc.

In the present invention, the fine powder prepared in the milling step is recovered directly into a solvent to form a slurry without exposing the fine powder to the surrounding air. Since the solvent covering the surface of the fine powder prevents the fine powder from coming into contact with air, the oxidation of the fine powder is minimized. The solvent may be selected from mineral oils, vegetable oils, synthetic oils and any mixture thereof. The mineral oils and synthetic oils usable in the present invention belong to Group 4, Second and Third Class Petroleums regulated by Japanese Fire Service Law. Specifically, the mineral oils and synthetic oils have a flash point of 21° C. or higher and lower than 200° C., a fractionating point of 400° C. or lower under 1 atm, and a kinematic viscosity of 10 cSt or less at ordinary temperature. Oils having a flash point lower than 21° C. are not suitable for the industrial production using a large amount of oils, because a great deal of expense and effort are required to maintain the safety. Also, oils having a fractionating point higher than 400° C. under 1 atm and/or a kinematic viscosity higher than 10 cSt at ordinary temperature are not suitable, because the oils are not easily removed and remain in a green body after the removing step. The oils remaining in the green body increases the carbon content of the final sintered magnet to decrease the coercive force iHc. The vegetable oils usable in the present invention may be soybean oil, corn oil, sunflower oil, rape oil, safflower oil, and any mixture thereof.

The slurry is then wet-compacted into a green body while applying a magnetic field under conditions known in the art. Since the green body contains a large amount of the solvent, the green body is protected against the oxidation.

Then the solvent remaining in the green body is removed. The method of removing the solvent is not strictly limited, and a removal by heating in a vacuum furnace is effective for treating a large number of green bodies at a time. The heating temperature is preferably 500° C. or lower, because the rare earth elements in the green body come to react with carbon in the solvent to increase the carbon content in the final sintered magnet when heated to a temperature higher than 500° C. The vacuum furnace capable of being evacuated to a vacuum degree of $5\times10^{-1}$ Torr or lower (no applied load) is preferable in view of preventing the increase in the oxygen amount in the green body.

Since the green body after the solvent removal is quite susceptible to the oxidation, the green body is sintered immediately after the removal is completed without bringing the green body into contact with air between the completion of the solvent removal and the beginning of sintering. The sintering conditions are not specifically limited as far as the sintering is carried out in a vacuum with or without flowing a small amount of argon gas or in an argon gas atmosphere.

The sintered product is then subjected to, if desired, a heat treatment and/or a surface treatment such as Ni-plating, epoxy resin coating, etc. to obtain the R—Fe—B-based, sintered permanent magnet of the present invention having a density of 7.53 g/cm$^3$ or more, and a coercive force iHc of 13 kOe or more.

To thoroughly prevent the oxidation as described above, the increase in the oxygen amount during the milling step and the subsequent steps can be minimized. Therefore, the oxygen content in the final sintered magnet is nearly the same as that of the starting coarse alloy powder prepared by the reductive diffusion method. Thus, according to the present invention, a sintered permanent magnet containing a significantly small amount of oxygen and having a high coercive force iHc, as compared with the magnets obtained by known methods, can be obtained.

The method described above is applicable to the production of an R—Fe—B-based, sintered permanent magnet where the coarse alloy powder prepared by the reductive diffusion method and a coarse alloy powder prepared by a known melting/casting method are used in combination as the starting material.

The content of the rare earth element R in the R—Fe—B-based, sintered permanent magnet thus produced is 27–34% by weight based on the magnet. When the content is smaller than 27% by weight, the coercive force (iHc) is insufficient. while the residual magnetic flux density (Br) is detrimentally reduced when exceeds 34% by weight. R is preferably Nd+Pr, Nd+Dy or Nd+Pr+Dy in view of attaining high magnetic properties. In addition, to achieve a higher density and a higher coercive force iHc, it is preferable that the sintered permanent magnet contains Dy in an amount up to 10% by weight.

The content of boron B is 0.5–2% by weight. When the content is smaller than 0.5% by weight, a sufficient coercive force iHc cannot be attained, while the residual magnetic flux density Br is detrimentally reduced when exceeds 2% by weight.

Thus, the R—Fe—B-based, sintered permanent magnet of the present invention has a chemical composition basically comprising, in terms of percent by weight, 27–34% of R wherein R is at least one rare earth element including Y, 0.5–2% of B and a balance of Fe. The R—Fe—B-based, sintered permanent magnet may further contain impurities such as N, O, C, and Ca and/or Mg in amounts mentioned below.

When the R—Fe—B-based, coarse alloy powder is finely pulverized in a nitrogen atmosphere having an oxygen content of 0.01 volume % or less, the resultant R—Fe—B-based, sintered permanent magnet contains nitrogen N in an amount of 0.01–0.1% by weight. When the R—Fe—B-based, coarse alloy powder is finely pulverized in an argon atmosphere having an oxygen content of 0.01 volume % or less, the resultant R—Fe—B-based, sintered permanent magnet contains N in an amount not less than 0.005% by weight and less than 0.01% by weight. When the content of N exceeds 0.1% by weight, the coercive force iHc is lowered because the amount of rare earth elements contributing to the coercive force iHc is reduced. When the content is lower than 0.005% by weight, the resultant R—Fe—B-based, sintered permanent magnet after the surface treatment has a poor corrosion resistance when put into practical uses.

The content of oxygen O is 0.5% by weight or less excluding zero, preferably 0.2–0.5% by weight, and more preferably 0.2–0.3% by weight. A content exceeding 0.5% by weight reduces the amount of the rare earth elements contributing to the coercive force iHc, thereby making it difficult to achieve a density of 7.53 g/cm$^3$ or more and a coercive force iHc of 13 kOe or more in the resultant R—Fe—B-based, sintered permanent magnet. The R—Fe—B-based, coarse alloy powder prepared by the reductive diffusion method generally contains oxygen in an amount at least 0.2% by weight. Therefore, it is practically difficult to reduce the oxygen content of the sintered magnet to a level smaller than 0.2% by weight.

The content of carbon C is 0.2% by weight or less excluding zero, preferably 0.001–0.2% by weight, and more preferably 0.001–0.1% by weight. When the content exceeds 0.2% by weight, rare earth carbides are formed in an unfavorably large amount to make it difficult to achieve a density of 7.53 g/cm$^3$ or more and a coercive force iHc of 13 kOe or more in the resultant R—Fe—B-based, sintered permanent magnet. The R—Fe—B-based, coarse alloy powder prepared by the reductive diffusion method generally contains carbon in an amount at least 0.02% by weight. Therefore, it is practically difficult to reduce the carbon content of the sintered magnet to a level smaller than 0.02% by weight.

The content of calcium Ca is 0.2% by weight or less excluding zero, preferably 0.0001–0.2% by weight, and more preferably 0.0001–0.1% by weight. When the content exceeds 0.2% by weight, non-magnetic Ca compounds having no contribution to the magnetic properties are formed in an unfavorably large amount to make it difficult to achieve a density of 7.53 g/cm$^3$ or more and a coercive force iHc of 13 kOe or more in the resultant R—Fe—B-based, sintered permanent magnet. Since the R—Fe—B-based, coarse alloy powder prepared by the reductive diffusion method generally contains Ca in an amount at least 0.02% by weight, it is practically difficult to reduce the Ca content of the sintered magnet to a level smaller than 0.02% by weight.

When metallic Mg is used as the reducing agent, the content of magnesium Mg in the resultant R—Fe—B-based, sintered permanent magnet is 0.02% by weight or less excluding zero, preferably 0.0001–0.2% by weight, and more preferably 0.0001–0.1% by weight.

When both metallic Ca and metallic Mg are used in combination, the amount of Ca+Mg in the resultant R—Fe—B-based, sintered permanent magnet is 0.2% by weight or less excluding zero, preferably 0.0001–0.2% by weight, and more preferably 0.0001–0.1% by weight.

A part of the balance of Fe may be replaced by at least one element selected from the group consisting of Nb, Al, Co, Ga and Cu.

Nb may be added in an amount of 0.1–2% by weight based on the sintered magnet to prevent the crystalline grains from becoming coarser during the sintering process. When less than 0.1% by weight, no effect is obtained, while the residual magnetic flux density Br is reduced when more than 2% by weight.

Al may be added in an amount of 0.02–2% by weight to enhance the coercive force iHc. When less than 0.02% by weight, no effect is obtained, while the residual magnetic flux density Br is reduced when more than 2% by weight.

Co may be added in an amount of 0.3–5% by weight to improve the corrosion resistance of the sintered magnet. When less than 0.3% by weight, no effect is obtained, while both the coercive force iHc and the residual magnetic flux density Br are reduced when more than 5% by weight.

Ga may be added in an amount of 0.01–0.5% by weight to improve the coercive force iHc. When less than 0.01% by weight, no effect is obtained, while the residual magnetic flux density Br is reduced when more than 0.5% by weight.

Cu may be added in an amount of 0.01–1% by weight to improve the coercive force iHc. When less than 0.01% by weight, no effect is obtained, while the residual magnetic flux density Br is reduced when more than 1% by weight.

The R—Fe—B-based, sintered permanent magnet of the present invention preferably has an oxygen content of 0.5% by weight or less, a density of 7.53 g/cm$^3$ or higher, a coercive force iHc of 13 kOe or more and a maximum energy product (BH)max of 33 MGOe or more; more preferably an oxygen content of 0.3% by weight or less, a density of 7.55 g/cm$^3$ or higher, a coercive force iHc of 14 kOe or more and a maximum energy product (BH)max of 34 MGOe or more; and particularly preferably an oxygen content of 0.3% by weight or less, a density of 7.56 g/cm$^3$ or higher, a coercive force iHc of 15 kOe or more and a maximum energy product (BH)max of 35 MGOe or more. The R—Fe—B-based, sintered permanent magnet having the above properties may be produced in the manner described above, preferably using a coarse alloy powder having an oxygen content of 0.27% by weight or less, more preferably 0.25% by weight or less.

As described above, according to the present invention, an R—Fe—B-based, sintered permanent magnet having a low oxygen content can be obtained even when a coarse alloy powder prepared by the reductive diffusion method is used as the starting powder. This low oxygen content prevents the formation of non-magnetic phase adversely affecting the magnetic properties and extremely improves the sinterability. As a result thereof, the R—Fe—B-based, sintered permanent magnet of the present invention has a density quite close to the theoretical density as well as a high coercive force iHc and a high maximum energy product (BH)max. Therefore, the present invention is of an important significance in the industrial production of the R—Fe—B-based, sintered permanent magnet in a low production cost. In addition, the present invention can be applied to known powder metallurgical methods to produce sintered products having a low oxygen content as well as to produce the R—Fe—B-based, sintered permanent magnet.

The present invention will be further described while referring to the following Examples which should be considered to illustrate various preferred embodiments of the present invention.

EXAMPLE 1

A coarse alloy powder was prepared by a known reductive diffusion method. Specifically, $Nd_2O_3$, $Dy_2O_3$ and $Pr_6O_{11}$ were reduced by metallic Ca to the rare earth elements which were then diffused into Fe powder, Fe—B powder, etc. After removing by-produced CaO by dissolving it in water and drying, the coarse alloy powder having the following composition was obtained.

| Composition of Coarse Alloy Powder (% by weight) | | | | | | | | | | | |
|---|---|---|---|---|---|---|---|---|---|---|---|
| Nd | Pr | Dy | B | Nb | Al | Ga | O | C | N | Ca | Fe |
| 24.3 | 7.0 | 0.7 | 1.03 | 0.5 | 0.1 | 0.08 | 0.27 | 0.05 | 0.02 | 0.14 | balance |

50 kg of the coarse alloy powder were milled to a fine powder having an average particle size of 4.2 $\mu$m in a jet mill under a milling pressure of 7.5 kfg/cm$^2$ in a nitrogen gas atmosphere having an oxygen content of 0.001 volume %. The fine powder was directly recovered into a mineral oil (tradename: Idemitsu Super Sol PA-30, manufactured by Idemitsu Kosan Co., Ltd., having a flash point of 81° C., a fractionating point of 204–282° C. under 1 atm and a kinematic viscosity of 2.0 cSt at ordinary temperature) and made into a slurry without bringing the fine powder into contact with air.

The slurry was wet-compacted into a green body in a molding machine equipped with a magnetically anisotropic die under a molding pressure of 0.8 ton/cm$^2$ while applying an orientating magnetic field of 10 kOe. Then, the mineral oil was removed by heating the green body at 200° C. for 2 hours in a vacuum of $5\times10^{-2}$ Torr, and the green body was successively sintered at 1070° C. for 3 hours in a vacuum of $3\times10^{-4}$ Torr without bringing the green body into contact with air. The sintered product had a density of 7.56 g/cm$^3$ and the following composition.

| Composition of Sintered Product (% by weight) | | | | | | | | | | | |
|---|---|---|---|---|---|---|---|---|---|---|---|
| Nd | Pr | Dy | B | Nb | Al | Ga | O | C | N | Ca | Fe |
| 24.2 | 6.9 | 0.7 | 1.03 | 0.5 | 0.1 | 0.08 | 0.29 | 0.08 | 0.05 | 0.14 | balance |

The sintered product was heat-treated in argon gas atmosphere at 900° C. for one hour and at 550° C. for 2 hours, and then machined to obtain an R—Fe—B-based, sintered permanent magnet of the present invention having high magnetic properties as shown in Table 1.

COMPARATIVE EXAMPLE 1

In the same manner as in Example 1 except for controlling the oxygen concentration of the nitrogen gas atmosphere to 0.2 volume %, a fine powder having an average particle size of 4.1 $\mu$m was prepared from 50 kg of the same coarse alloy powder as used in Example 1. The fine powder thus prepared had the following composition.

| Composition of Fine Powder (% by weight) | | | | | | | | | | | |
|---|---|---|---|---|---|---|---|---|---|---|---|
| Nd | Pr | Dy | B | Nb | Al | Ga | O | C | N | Ca | Fe |
| 24.2 | 7.0 | 0.7 | 1.03 | 0.5 | 0.1 | 0.08 | 0.72 | 0.05 | 0.02 | 0.14 | balance |

The fine powder was compacted in a molding machine equipped with a magnetically anisotropic die under a molding pressure of 0.8 ton/cm$^2$ while applying an orientating magnetic field of 10 kOe to produce a green body which was then sintered at 1090° C. for 3 hours in a vacuum of 5×10–4 Torr. The sintered product had the following composition.

| Composition of Sintered Product (% by weight) | | | | | | | | | | | |
|---|---|---|---|---|---|---|---|---|---|---|---|
| Nd | Pr | Dy | B | Nb | Al | Ga | O | C | N | Ca | Fe |
| 24.2 | 7.0 | 0.7 | 1.03 | 0.5 | 0.1 | 0.08 | 0.67 | 0.07 | 0.02 | 0.14 | balance |

The density of the sintered product was as low as 7.51 g/cm$^3$ due to a high oxygen content of 0.67% by weight. The sintered product was heat-treated in argon gas atmosphere at 900° C. for one hour and at 550° C. for 2 hours, and then machined to obtain a comparative R—Fe—B-based, sintered permanent magnet. As seen from Table 1, the coercive force iHc of the comparative magnet was low by 3.2 kOe as compared with Example 1.

EXAMPLE 2

A defective R—Fe—B-based, sintered permanent magnet due to cracking, etc. was pulverized into a powder, to which $Nd_2O_3$, $Pr_6O_{11}$, $Dy_2O_3$, Fe powder, Co powder, Fe—B powder, etc. were added together with metallic Ca as the reducing agent. The resultant powder mixture was subjected to a reductive diffusion treatment. After removing by-produced CaO by dissolving it in water and a subsequent drying, a coarse alloy powder having the following composition was obtained.

| Composition of Coarse Alloy Powder (% by weight) | | | | | | | | | | | | | |
|---|---|---|---|---|---|---|---|---|---|---|---|---|---|
| Nd | Pr | Dy | B | Nb | Al | Co | Ga | Cu | O | C | N | Ca | Fe |
| 22.0 | 6.4 | 4.0 | 1.05 | 0.8 | 0.3 | 2.1 | 0.15 | 0.1 | 0.38 | 0.09 | 0.02 | 0.15 | balance |

80 kg of the coarse alloy powder were milled to a fine powder having an average particle size of 4.5 $\mu$m in a jet mill under a milling pressure of 7.0 kfg/cm$^2$ in a nitrogen gas atmosphere having an oxygen content of 0.002 volume %. The fine powder was directly recovered into a synthetic oil (tradename: DN. ROLL OIL AL-35, manufactured by Idemitsu Kosan Co., Ltd., having a flash point of 106° C., a fractionating point of 231–258° C. under 1 atm and a kinematic viscosity of 2.1 cSt at ordinary temperature) and made into a slurry without bringing the fine powder into contact with air.

The slurry was wet-compacted into a green body in a molding machine equipped with a magnetically anisotropic die under a molding pressure of 1.0 ton/cm$^2$ while applying an orientating magnetic field of 12 kOe. Then, the synthetic oil was removed by heating the green body at 180° C. for 3 hours in a vacuum of $3\times10^{-2}$ Torr, and the green body was successively sintered at 1080° C. for 4 hours in a vacuum of $5\times10^{-4}$ Torr without bringing the green body into contact with air. The sintered product had a density of 7.57 g/cm$^3$ and the following composition.

| Composition of Sintered Product (% by weight) | | | | | | | | | | | | | |
|---|---|---|---|---|---|---|---|---|---|---|---|---|---|
| Nd | Pr | Dy | B | Nb | Al | Co | Ga | Cu | O | C | N | Ca | Fe |
| 21.9 | 6.3 | 4.0 | 1.05 | 0.8 | 0.3 | 2.1 | 0.15 | 0.1 | 0.41 | 0.12 | 0.04 | 0.15 | balance |

The sintered product was heat-treated in argon gas atmosphere at 900° C. for one hour and at 580° C. for 2 hours, and then machined to obtain an R—Fe—B-based, sintered permanent magnet of the present invention having high magnetic properties as shown in Table 1.

COMPARATIVE EXAMPLE 2

In the same manner as in Example 2 except for controlling the oxygen concentration of the nitrogen gas atmosphere to 0.1 volume %, a fine powder having an average particle size of 4.3 $\mu$m was prepared from 80 kg of the same coarse alloy powder as used in Example 2. The fine powder thus prepared had the following composition.

| Composition of Fine Powder (% by weight) | | | | | | | | | | | | | |
|---|---|---|---|---|---|---|---|---|---|---|---|---|---|
| Nd | Pr | Dy | B | Nb | Al | Co | Ga | Cu | O | C | N | Ca | Fe |
| 21.9 | 6.2 | 4.0 | 1.05 | 0.8 | 0.3 | 2.1 | 0.15 | 0.1 | 0.76 | 0.12 | 0.02 | 0.15 | balance |

The fine powder was compacted in a molding machine equipped with a magnetically anisotropic die under a molding pressure of 1.0 ton/cm$^2$ while applying an orientating magnetic field of 12 kOe to produce a green body, which was then sintered at 1100° C. for 4 hours in a vacuum of $3\times10^{-4}$ Torr to obtain a sintered product having the following composition.

| Composition of Sintered Product (% by weight) | | | | | | | | | | | | | |
|---|---|---|---|---|---|---|---|---|---|---|---|---|---|
| Nd | Pr | Dy | B | Nb | Al | Co | Ga | Cu | O | C | N | Ca | Fe |
| 21.9 | 6.2 | 4.0 | 1.05 | 0.8 | 0.3 | 2.1 | 0.15 | 0.1 | 0.70 | 0.12 | 0.02 | 0.15 | balance |

The density of the sintered product was as low as 7.50 g/cn$^3$ due to a high oxygen content of 0.70% by weight. The sintered product was heat-treated in argon gas atmosphere at 900° C. for one hour and at 580° C. for 2 hours, and then machined to obtain a comparative R—Fe—B-based, sintered permanent magnet. As seen from Table 1, the coercive force iHc of the comparative magnet was low by 4.5 kOe as compared with Example 2.

EXAMPLE 3

A defective R—Fe—B-based, sintered permanent magnet due to cracking, etc. was pulverized into a powder, to which metallic Ca as the reducing agent was added. The resultant powder mixture was subjected to a reductive diffusion treatment. After removing by-produced CaO by dissolving it in water and a subsequent drying, a coarse alloy powder having the following composition was obtained.

| Composition of Coarse Alloy Powder (% by weight) | | | | | | | | | | | |
|---|---|---|---|---|---|---|---|---|---|---|---|
| Nd | Pr | Dy | B | Nb | Co | Al | O | C | N | Ca | Fe |
| 27.5 | 0.5 | 1.5 | 1.00 | 0.7 | 2.0 | 0.1 | 0.25 | 0.07 | 0.04 | 0.12 | balance |

100 kg of the coarse alloy powder were milled to a fine powder having an average particle size of 4.0 $\mu$m in a jet mill under a milling pressure of 7.5 kfg/cm$^2$ in an argon gas atmosphere having an oxygen content of 0.0005 volume %. The fine powder was directly recovered into kerosene and made into a slurry without bringing the fine powder into contact with air.

The slurry was wet-compacted into a green body in a molding machine equipped with a magnetically anisotropic die under a molding pressure of 1.5 ton/cm$^2$ while applying an orientating magnetic field of 8 kOe. Then, the kerosene was removed by heating the green body at 150° C. for 6 hours in a vacuum of $5\times10^{-2}$ Torr, and the green body was successively sintered at 1060° C. for 3 hours in a vacuum of $5\times10^{-5}$ Torr without bringing the green body into contact with air. The sintered product had a density of 7.59 g/cm$^3$ and the following composition.

| Composition of Sintered Product (% by weight) | | | | | | | | | | | |
|---|---|---|---|---|---|---|---|---|---|---|---|
| Nd | Pr | Dy | B | Nb | Co | Al | O | C | N | Ca | Fe |
| 27.4 | 0.5 | 1.5 | 1.00 | 0.7 | 2.0 | 0.1 | 0.26 | 0.09 | 0.04 | 0.12 | balance |

The sintered product was heat-treated in argon gas atmosphere at 900° C. for 2 hours and at 500° C. for 2 hours, and then machined to obtain an R—Fe—B-based, sintered permanent magnet of the present invention having high magnetic properties as shown in Table 1.

COMPARATIVE EXAMPLE 3

In the same manner as in Example 3 except for controlling the oxygen concentration of the argon gas atmosphere to 0.05 volume %, a fine powder having an average particle size of 4.0 $\mu$m was prepared from 100 kg of the same coarse alloy powder as used in Example 3. The fine powder thus prepared had the following composition.

| Composition of Fine Powder (% by weight) | | | | | | | | | | | |
|---|---|---|---|---|---|---|---|---|---|---|---|
| Nd | Pr | Dy | B | Nb | Co | Al | O | C | N | Ca | Fe |
| 27.5 | 0.4 | 1.5 | 1.00 | 0.7 | 2.0 | 0.1 | 0.59 | 0.08 | 0.04 | 0.12 | balance |

The fine powder was compacted in a molding machine equipped with a magnetically anisotropic die under a molding pressure of 1.5 ton/cm$^2$ while applying an orientating magnetic field of 8 kOe to produce a green body, which was then sintered at 1080° C. for 3 hours in a vacuum of $3\times10^{-5}$ Torr to obtain a sintered product having the following composition.

| Composition of Sintered Product (% by weight) | | | | | | | | | | | |
|---|---|---|---|---|---|---|---|---|---|---|---|
| Nd | Pr | Dy | B | Nb | Co | Al | O | C | N | Ca | Fe |
| 27.5 | 0.4 | 1.5 | 1.00 | 0.7 | 2.0 | 0.1 | 0.54 | 0.08 | 0.04 | 0.12 | balance |

The density of the sintered product was as low as 7.52 g/cm$^3$. The sintered product was heat-treated in argon gas atmosphere at 900° C. for 2 hours and at 500° C. for 2 hours, and then machined to obtain a comparative R—Fe—B-based, sintered permanent magnet. As seen from Table 1, the coercive force iHc and the maximum energy product (BH) max of the comparative magnet were extremely low as compared with Example 3.

EXAMPLE 4

In the same manner as in Example 1 except for conducting the jet-milling in an argon gas atmosphere having an oxygen concentration of 0.001 volume %, a fine powder having an average particle size of 4.0 $\mu$m was prepared from 50 kg of the same coarse alloy powder as used in Example 1. The fine powder was directly recovered into a mineral oil (tradename: Idemitsu Super Sol PA-30, manufactured by Idemitsu Kosan Co., Ltd., having a flash point of 81° C., a fractionating point of 204–282° C. under 1 atm and a kinematic viscosity of 2.0 cSt at ordinary temperature) and made into a slurry without bringing the fine powder into contact with air.

The slurry was wet-compacted and then successively sintered in the same manner as in Example 1 to obtain a sintered product having a density of 7.56 g/cm$^3$ and the following composition.

| Composition of Sintered Product (% by weight) | | | | | | | | | | | |
|---|---|---|---|---|---|---|---|---|---|---|---|
| Nd | Pr | Dy | B | Nb | Al | Ga | O | C | N | Ca | Fe |
| 24.2 | 6.9 | 0.7 | 1.03 | 0.5 | 0.1 | 0.08 | 0.29 | 0.08 | 0.008 | 0.14 | balance |

The sintered product was heat-treated in argon gas atmosphere at 900° C. for one hour and at 550° C. for 2 hours, and then machined to obtain an R—Fe—B-based, sintered permanent magnet of the present invention having high magnetic properties as shown in Table 1.

TABLE 1

| | Sintered Product | | | | |
|---|---|---|---|---|---|
| No. | Oxygen Content (% by weight) | Density (g/cm$^3$) | Br (kG) | iHc (kOe) | (BH)max (MGOe) |
| Examples | | | | | |
| 1 | 0.29 | 7.56 | 12.8 | 16.0 | 39.1 |
| 2 | 0.41 | 7.57 | 12.0 | 22.0 | 34.5 |
| 3 | 0.26 | 7.59 | 13.8 | 14.7 | 45.6 |
| 4 | 0.29 | 7.56 | 12.8 | 16.0 | 39.1 |
| Comparative Examples | | | | | |
| 1 | 0.67 | 7.51 | 12.7 | 12.8 | 36.8 |
| 2 | 0.70 | 7.50 | 11.9 | 17.5 | 32.4 |
| 3 | 0.54 | 7.52 | 13.7 | 5.0 | 26.5 |

What is claimed is:

1. An R—Fe—B-based, sintered permanent magnet having a density of 7.53 g/cm$^3$ or more, wherein R is at least one rare earth element including Y, having a composition comprising 27–34% by weight of R, 0.5–2% by weight of B, 0.3% by weight or less of O, 0.2% by weigh or less, excluding zero, of Ca and a balance of Fe.

2. The R—Fe—B-based, sintered permanent magnet according to claim 1, further containing 0.01–0.1% by weight of N and 0.2% by weight or less of C.

3. The R—Fe—B-based, sintered permanent magnet according to claim 1, wherein a part of said balance of Fe is replaced by at least one element selected from the group consisting of 0.1–2% by weight of Nb, 0.02–2% by weight of Al, 0.3–5% by weight of Co, 0.01–0.5% by weight of Ga and 0.01–1% by weight of Cu.

4. The R—Fe—B-based, sintered permanent magnet according to claim 2, wherein a part of said balance of Fe is replaced by at least one element selected from the group consisting of 0.1–2% by weight of Nb, 0.02–2% by weight of Al, 0.3–5% by weight of Co, 0.01–0.5% by weight of Ga and 0.01–1% by weight of Cu.

5. An R—Fe—B-based, sintered permanent magnet having a density of 7.53 /cm$^3$ or more, wherein R is at least one rare earth element including Y, having a composition comprising 27–34% by weight of R, 0.5–2% by weight of B, 0.3% by weight or less of O, 0.2% by weigh or less, excluding zero, of Ca, at least 0.005% by weight but less than 0.01% by weight of N, 0.2% by weight or less of C, and a balance of Fe.

6. The R—Fe—B-based, sintered permanent magnet according to claim 5, wherein a part of said balance of Fe is replaced by at least one element selected from the group consisting of 0.1–2% by weight of Nb, 0.02–2% by weight of Al, 0.3–5% by weight of Co, 0.01–0.5% by weight of Ga and 0.01–1% by weight of Cu.

7. A method of producing an R—Fe—B based, sintered permanent magnet having a density of 7.53 g/cm$^3$ or more, wherein R is at least one rare earth element including Y, having a composition comprising 27–34% by weight of R, 0.5–2% by weight of B, 0.3% by weight or less of O, 0.2% by weight or less, excluding zero, of Ca and a balance of Fe comprising steps of:

milling an R—Fe—B-based, coarse alloy powder prepared by a reductive diffusion method into a fine powder in an atmosphere containing oxygen in an amount of 0.01 volume % or less, said atmosphere being a nitrogen gas atmosphere, an argon gas atmosphere, or a mixed atmosphere of nitrogen gas and argon gas;

directly recovering said fine powder into a solvent to form a slurry without bringing said fine powder into contact with air, said solvent being a mineral oil, a synthetic oil, a vegetable oil or a mixture thereof;

wet-compacting said slurry to form a green body while applying a magnetic field;

removing said solvent from said green body; and sintering said green body in a vacuum or in an argon gas atmosphere while preventing said green body from being brought into contact with air between said removing step and said sintering step, wherein the R—Fe—B based, sintered permanent magnet has a density of 7.53 g/cm$^3$ or more, R is at least one rare earth element and has a composition comprising 27–34% by weight of R, 0.5–2% by weight of B, 0.3% by weight or less of 0 0.2% by weight or less, excluding zero, of Ca and a balance of Fe.

8. The method according to claim 7, wherein said coarse alloy powder prepared by a reductive diffusion method contains oxygen in an amount of 0.27% by weight or less.

9. A method of producing an R—Fe—B-based, sintered permanent magnet having a density of 7.53 g/cm$^3$ or more, wherein R is at least one rare earth element including Y, having a composition comprising 27–34% by weight of R, 0.5–2% by weight of B, 0.3% by weight or less of O, 0.2% by weight or less, excluding zero, of Ca, at least 0.005% by weight but less than 0.01% by weight of N, 0.2% by weight or less of C, and a balance of Fe, comprising steps of:

milling an R—Fe—B-based, coarse alloy powder prepared by a reductive diffusion method contains oxygen in an amount of 0.27% by weight or less, said atmosphere being a nitrogen gas atmosphere, an argon gas atmosphere, or a mixed atmosphere of nitrogen gas and argon gas;

directly recovering said fine powder into a solvent to form a slurry without bringing said fine powder into contact with air, said solvent being a mineral oil, a synthetic oil, a vegetable oil or a mixture thereof;

wet-compacting said slurry to form a green body while applying a magnetic field;

removing said solvent from said green body; and sintering said green body in a vacuum or in an argon gas atmosphere while preventing said green body from being brought into contact with air between said removing step and said sintering step, wherein the R—Fe—B-based, sintered permanent magnet has a density of 7.53 g/cm$^3$ or more, R is at least one rare earth element including Y, has a composition comprising 27–34% by weight of R, 0.5–2% by weight of B, 0.3% by weight or less of O, 0.2% by weight or less, excluding zero, of Ca, at least 0.005% by weight but less than 0.01% by weight of N, 0.2% by weight or less of C, and a balance of Fe.

* * * * *